US006021712A

United States Patent [19]

Harrop

[11] Patent Number: 6,021,712

[45] Date of Patent: Feb. 8, 2000

[54] CONTROL SYSTEM FOR TRASH COMPACTION APPARATUS INCLUDING OPERATOR IDENTIFICATION AND AUTHORIZATION FEATURES

[75] Inventor: Shannon Harrop, Springdale, Ark.

[73] Assignee: J.V. Manufacturing, Inc., Springdale, Ark.

[21] Appl. No.: 09/310,533

[22] Filed: May 12, 1999

[51] Int. Cl.[7] ..... B30B 15/26

[52] U.S. Cl. ..... 100/43; 100/229 A

[58] Field of Search ..... 100/43, 48, 99, 100/229 A

[56] References Cited

U.S. PATENT DOCUMENTS

| | | |
|---|---|---|
| 3,802,335 | 4/1974 | Longo . |
| 4,232,599 | 11/1980 | Ulrich . |
| 4,323,771 | 4/1982 | Chalker et al. . |
| 4,538,056 | 8/1985 | Young et al. . |
| 4,643,087 | 2/1987 | Fenner et al. . |
| 4,953,109 | 8/1990 | Burgis . |
| 4,993,882 | 2/1991 | Nishizuka et al. . |
| 5,016,197 | 5/1991 | Neumann et al. . |
| 5,610,688 | 3/1997 | Inamoto et al. . |
| 5,713,270 | 2/1998 | Fitzgerald et al. . |
| 5,717,867 | 2/1998 | Wynn et al. . |
| 5,871,435 | 2/1999 | Numata et al. . |

FOREIGN PATENT DOCUMENTS

| | | |
|---|---|---|
| 7-53005 | 2/1995 | Japan . |

*Primary Examiner*—Stephen F. Gerrity
*Attorney, Agent, or Firm*—Robert R. Keegan; Head, Johnson & Kachigian

[57] ABSTRACT

A trash compaction apparatus, specifically a waste paper baler, incorporating an improvement in the controls for the apparatus whereby proper identification from a proposed operator is required to start a compaction operation. In particular, the compaction apparatus has associated therewith a magnetic stripe card reader and a computer. In the computer memory, data is stored which may be compared with data read by the card reader from a would-be operator of the apparatus to determine if such person is an authorized operator. An input-output unit is provided for inputting the data for the authorized operator ID function. A calendar and a clock in the computer enables a log to be created in computer memory with date, time and identification data for each attempted operation of the apparatus. The computer calendar routine can also optionally determine if a would-be operator has attained an age required for safe and legal apparatus operation. The apparatus remains accessible for deposit of waste material while preventing unauthorized starting of compaction operations. An optional keypad may be included in the apparatus to provide additional or alternative means for entering data for validation of authorization of an operator.

16 Claims, 4 Drawing Sheets

CONTROL SYSTEM FOR TRASH COMPACTION APPARATUS INCLUDING OPERATOR IDENTIFICATION AND AUTHORIZATION FEATURES

CROSS REFERENCE TO RELATED APPLICATION

None.

TECHNICAL FIELD

The present invention relates to compaction apparatus, particularly waste paper balers and industrial trash compactors, in particular such trash compactions devices that include a control system which requires some identifying data from a prospective operator to assure that the operator is qualified and authorized to operate the particular compaction apparatus.

BACKGROUND OF THE INVENTION

The present invention relates to compaction equipment for commercial and industrial trash compaction to facilitate refuse disposal and to waste paper baler equipment utilized in paper recycling, both of which are important and widely used tools in the field of waste management. It is very desirable that this equipment be both efficient and reliable. As with all powerful mechanical equipment, safety hazards should be eliminated to the maximum extent possible, recognizing that there is a tendency for some operators to be less careful than they should be. There is a need to prevent operation by unauthorized persons who may or may not be in the area by permission.

Although the invention with which this application is concerned is useful in both waste paper balers and in trash compactors, this background discussion will primarily concern itself with balers, since they are possibly the more frequently used by a variety of different operators. Balers comprise vertical presses for forming bales of compacted paper material for recycling purposes. They are often found where discard cardboard boxes are accumulated. See U.S. Pat. No. 4,232,599 issued Nov. 11, 1980 to Ulrich. The commercial or industrial trash compactor, which will be referred to herein simply as "trash compactor", is found in many situations where there are large volumes of waste to be disposed of in landfills or other waste disposal facilities. Thus, balers or trash compactors are found in shopping centers, industrial complexes, associated with large discount stores or department stores, and in some residential complexes.

Although operational control of compaction apparatus in years past was usually implemented by simple switches and relays, there has been a tendency in recent years to employ computer microprocessors and somewhat sophisticated computer programs and algorithms stored in computer memory in or associated with the microprocessor. The present invention is adaptable for use with either relay or microprocessor implemented controls.

U.S. Pat. No. 4,953,109 to Burgis, U.S. Pat. No. 5,016,197 to Neumann, et al. and U.S. Pat. No. 5,558,013 to Blackstone, Jr. are examples of trash compaction systems utilizing microprocessors and computer programs to implement a desired control system. U.S. Pat. No. 3,802,335 to Longo and U.S. Pat. No. 4,643,087 to Fenner et al. discuss systems which do not employ computer microprocessors but execute simple logic with electrical relays.

In the preferred embodiment, a magnetic strip card reader is employed capable of reading cards in the possession of each employee or person who may be authorized to have access to the compaction equipment in question. In many cases, employees may already be using such cards for the purpose of clocking in or clocking out from work thereby generating input data for accounting and payroll purposes. Examples of such time entry and accounting systems employing card readers may be seen in U.S. Pat. No. 5,717,867 to Winn et al, issued Feb. 10, 1998 and U.S. Pat. No. 4,538,056 to Young et al, issued Aug. 27, 1985. Other uses of card readers to identify employees and generate data for computer records or special purposes is known as illustrated in U.S. Pat. No. 5,871,435 to Numata et al, issued Feb. 16, 1999. The latter patent apparently identifies the user operating a centrifuge so that the operator can, at a later time, retrieve the resulting data of the centrifuge operation stored in a central computer memory. To the extent that techniques well known in the art for collecting data from cards read by card readers are shown in these prior patents, they are incorporated herein by reference as ordinary skill of the art helpful in carrying out the implementation of the inventions disclosed herein.

It should be noted that apparatus according to the present invention does not simply control an access door or otherwise limit access to an area or a machine. The baler or compaction apparatus with the authorized operator identification feature described herein is accessible to unauthorized operators, and it is only particular operations thereof such as compaction and bale forming which require that the operator be authorized. This is an important safety feature which comes under the purview of regulatory authorities as well as being a desirable provision of company safety policy.

SUMMARY OF THE INVENTION

The present invention departs from the teaching of prior art trash compaction and waste paper baler systems by providing apparatus which is simple, durable, reliable and provides safe and uncomplicated operation while preventing operation by unauthorized personnel. At the same time, it has control features which equal or exceed those of more complex systems and has a capability for collecting data regarding times of use, identification of users, and other data of possible interest.

In balers described herein a current sensing relay switch is employed to determine the time at which the baler ram or platen is reversed from extending operation to retracting operation which, of course, depends on the fullness of the bale-forming enclosure of the baler. It should be noted that the normal stopping of the ram in the reverse stroke is not responsive to the current sensing relay switch, but is, rather, controlled by limit switches or position sensing switches responding to ram position, and, in some compaction apparatus, to time delay devices coordinated with the travel time of the ram. Those aspects of compaction apparatus not directly involved here are fully described in U.S. application Ser. No. 09/218,348 filed Dec. 22, 1998.

The apparatus of the invention is capable of receiving additional, optional features which are not a part of the present invention. For example, a purchaser or user may specify an optional multi-cycle control feature whereby the ram of the compactor will extend and retract two or more times at each operation of the compactor ram by pressing the start button. Also an optional feature is available whereby the control system for the compactor is provided with a remote control panel connected by a short cable to the main control unit. According to the invention such a remote control would include operator identification features also.

Other optional features, some of which are illustrated herein, may or may not be included with apparatus incorporating the basic aspects of present invention.

In addition to providing the features and advantages referred to above, it is an object of the present invention to provide compaction apparatus for trash compactors and waste paper balers which have simple relay-implemented control systems and which include an operator identification feature employing a card reader or the like which also serves to prevent operation by unauthorized persons.

It is another object of the present invention to provide such compaction apparatus wherein a secondary input in the form of a key pad or the like provides supplemental means for entering ID or other data.

It is still another object of the present invention to provide such compaction apparatus controls with input-output means for transferring data to and from a hand-held unit for later transfer to a central multipurpose computer.

It is a further object of the present invention to provide such compaction apparatus controls having capability of determining identity of operators and their authorization status from data commonly encoded on employee cards such as birth date or social security number.

It is a still further object of the present invention to provide trash compaction apparatus with controls which requires the insertion of an operator identification card for certain functions and creates a log of data pertaining to time and operator ID for such operations.

In addition to the features and advantages of the compaction apparatus according to the invention described above, further advantages thereof will be apparent from the following description in conjunction with the appended drawings.

DETAILED DESCRIPTION OF THE PREFERRED EMBODIMENTS

Figure 1:
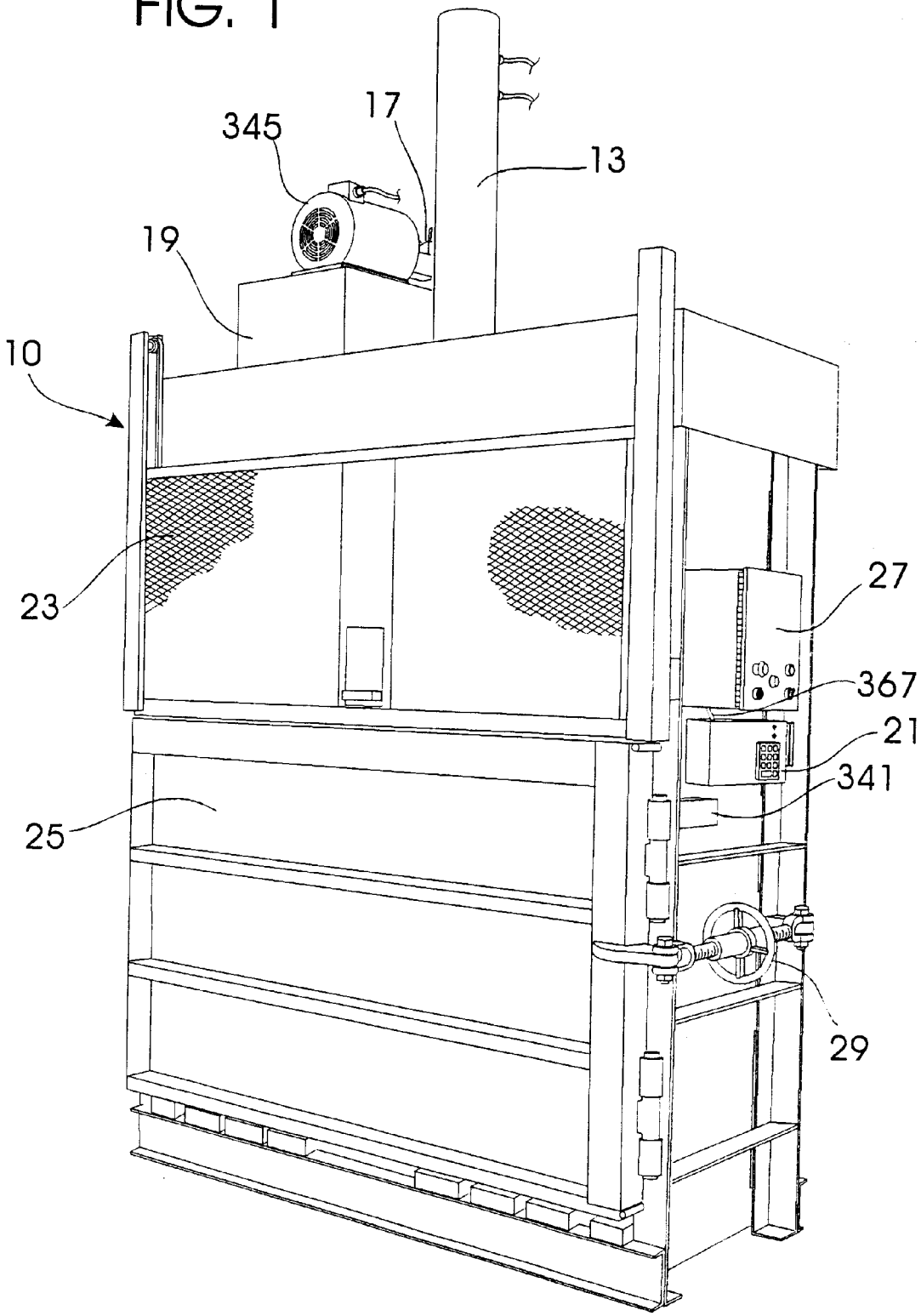
FIG. 1 is an isometric view of a compaction apparatus (baler) incorporating features of the present invention.

Referring to the drawings and, particularly to FIG. 1, compaction apparatus 10 is shown in the form of a vertical waste paper baler operating to compact materials therein and is actuated by a hydraulic cylinder 13, powered by a pump 17, operated by motor 345.

Motor 345 is provided with a starter unit and also appropriate safety devices, such as fuses or circuit breakers all in accordance with normal practice in the art. These elements forming no part of the invention generally are not shown. Similarly, hydraulic cylinder 13 has associated therewith conventional solenoid valves, relief valves and other conventional elements (not shown) along with hydraulic fluid reservoir housing 19. Features of the baler, such as bale ejection apparatus, form no part of this invention and are not shown. It will be understood that the general operation of the baler is similar to that shown in U.S. Pat. No. 4,232,599 issued Nov. 11, 1980, to Ulrich, and in U.S. patent application Ser. No. 09/218,348, filed Dec. 22, 1998, in the names of Shannon Harrop and James Davis.

Loading door 23 slides upward to provide access to the baler interior. Appropriate interlocks and other devices (not shown) are included to provide safe operation of the compaction apparatus, all in accordance with practice in the industry.

Chamber door 25 is hinged at the side and may be opened when waste material has been compressed to form a full bale at which time the bale may be secured by ties in conventional manner and removed from the baler by ejection apparatus. Chamber door switch 341 provides a proximity sensor for indicating that chamber door 25 is in the closed position. Controls for the safe and reliable operation of the compaction apparatus 10, later to be described, are located in control box 27.

The operation of the baler shown in FIG. 1 is generally conventional as will be apparent to those skilled in the art. Generally, a ram and a platen reside in the upward or fully retracted position while awaiting deposit of material to be compacted. Chamber door 25 is closed and locked as by the hand wheel lock mechanism 29 or some other suitable locking means appropriate to forces imparted to door 25 in the compaction process. With loading door 23 raised to its upward position for access to the interior of the baler, waste material is deposited in the baler underneath the platen. As the baler becomes full of uncompacted material, the controls on control panel 27 are set to turn the baler on, if necessary, and card reader 21 is used to initiate a compaction cycle.

This process is repeated with actuations by the card reader until a bale of waste material of the desired size is formed, at which time ties are put around the bale in a known manner. With chamber door 25 open, the ram is operated and used as a lift mechanism to operate an ejection device for tipping a bale out of the compactor. The ejection device forms no part of the present invention and is not shown and described herein. After removal of a bale from the baler, chamber door 25 is closed and locked and the baler is restored to the condition for accepting waste material to form another bale.

The operation of the basic circuit of the control system for baler 10 shown schematically in FIG. 2A will be understood more readily by reference to a table below entitled Baler Circuit as well as the following description.

Figure 2A:
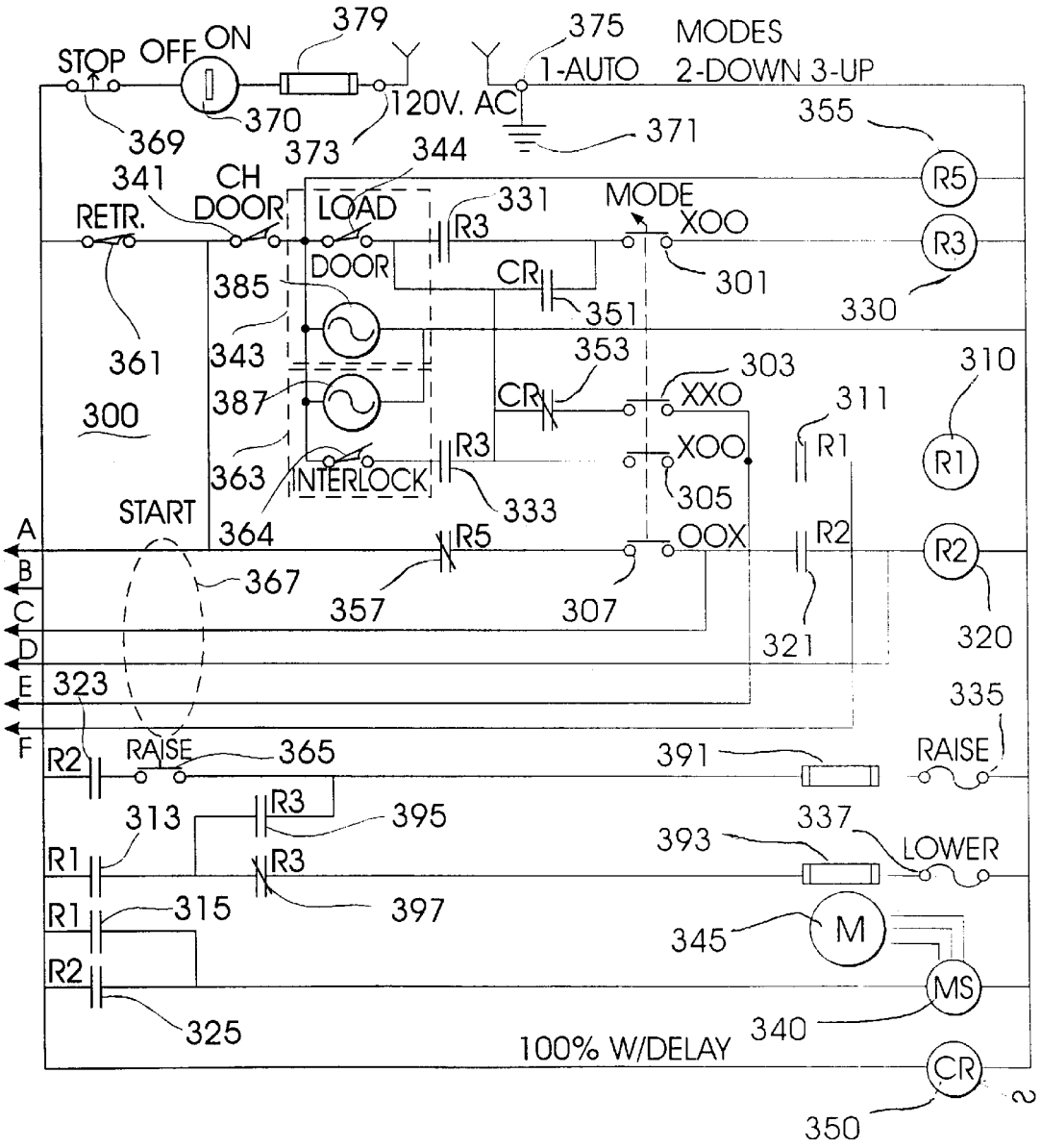
FIG. 2A is a schematic diagram of electrical and electromechanical components of the apparatus of FIG. 1.

Power is supplied to the circuit 300 of FIG. 2A at terminals 373 and 375 and is preferably 120V AC power. Normally the electric motor powering the pump for the hydraulic system will be provided with three-phase power and the single phase AC power, nominally of 120V, may be extracted from the three-phase power by a conventional transformer not shown in FIG. 2A. Alternatively, a different voltage of AC or DC power may be utilized to power the circuit 300. The three-phase power for pump motor 345 is shown schematically and only the controller for the motor in the form of motor starter 340 is actually an operative part of the circuit of FIG. 2A. It may also be noted that at least one of the conductors supplying current to motor 345 is inductively coupled to current relay 350 as indicated in FIG. 2A.

It should be noted in the circuit diagram of FIG. 2A that, in addition to a current relay, there are additional relays including relay 310, relay 320, relay 330, and relay 355. These relays are also designated R1, R2, R3, and R5, respectively, and the normally open or the normally closed contacts of each relay in the circuit diagram are marked to correspond to the designation of the relay which causes them to operate. For the current relay 350 the designation is CR.

It will be noted that terminal 375 is designated the ground terminal for the circuit and is connected to ground 371. Conventional fuse protection indicated by fuse 379 is included in the circuit and a stop button 369 is provided to quickly remove all power from the circuit. While stop button 369 may be used to turn on and turn off the control circuit, an additional on-off switch 370 is provided. When the circuit is supplied with power and is on, it will be in an idle condition until card reader unit 21 causes it to be activated through cable 367 (by closing contacts for conductors AB, CD, and EF) to prevent the baler from being operated by unauthorized personnel as will be described in relation to FIG. 2B below. Limit switch 361 is the retract limit switch which is closed when the ram and platen (presshead) of the baler are fully retracted.

Various interlock switches are provided which do not affect normal operation of the system provided that the chamber door and the loading door are in the proper position for the particular operation. Interlock switch 341 is the chamber door limit switch while interlock device 343 for the loading door and interlock device 363 for the loading door are preferably photo electric switches having respective infrared light sources 385 and 387. While current passing devices for interlock 343 and interlock 363 preferably are solid state devices, they are schematically shown as contacts 344 and 364.

In this description of the schematic diagram of FIG. 2A and its operation, it is assumed that it will initially be set in the automatic mode. The mode control switch 301 includes three other contacts 303, 305, and 307. As shown in FIG. 2A there are three modes, namely 1) auto, 2) down, and 3) up. The operation of switch contacts 301, 303, 305, and 307 is indicated by respective series of three symbols of X or O indicating whether the particular contact is closed (X) or open (O) for each of the modes auto, down, and up. For example, contact 303 is closed in the auto mode, is closed in the down mode and is open in the up mode, as indicated by the legend XXO.

As seen in the Baler Circuit table below, in the idle condition (before the start button 367 is pushed) none of the relays, R1, R2, R3, R5, or CR (current relay) are operated. Thus, in the idle condition, contacts 331, 351, 311, 333, 321, 335, 313, 315, and 325 are open; contacts 353, 357 and 337 are closed. In the idle condition and throughout the auto mode operation, contacts 301, 303 and 305 are closed while contact 307 is open.

Referring to the Baler Circuit table, to begin the operation, the card reader unit 21 must read a valid operation ID from an insert card in order for control circuit 300 to be activated. As shown in the Baler Circuit table, activating circuit 300 by closing contacts AB and CD, causes actuation of R1 relay 310 and R5 relay 355; it also causes actuation of motor starter 340 of the motor control.

After the ram has started extending, retract limit switch 361 assumes its normally closed position, and the valid ID signal is no longer activated. At some point determined to by the fullness of the baler, the ram and platen (press head) encounter substantial resistance causing an increase in hydraulic pressure with a corresponding increase in motor current and motor torque. This increase in current is sensed by the current relay 350 and, after a predetermined time delay of about 1 second to 6 seconds, current relay 350 closes and the ram is in fully extended position. Thereupon (extend) lower solenoid 337 (as indicated schematically in FIG. 2A) is deactivated. Note that in the vertical baler mechanism 10 "raise" equates to retract and "lower" equates to extend.

After the short delay predetermined by the current relay 350, the baler is controlled by baler control circuit 300 to begin the retract cycle at which time (retract) raise solenoid 335 is activated. Note that solenoid 335 and solenoid 337 are provided with fuses 391 and 393 in a conventional manner and their selection is basically determined by contacts 395 and 397 of relay R3. The retract portion of the cycle is terminated when the ram reaches the fully retracted position and retract limit switch 361 is operated to open the contacts thereof. At this time, all relays, R1, R2, R3, and R5 together with the current relay are deactivated with the result that the control circuit 300 is returned to the original idle condition. It is customary to include in the control unit for the baler provisions for manually raising and manually lowering the ram and press head, primarily for the purpose of using the hydraulically operated ram to power the ejection mechanism for the baler. See U.S. Pat. No. 4,232,599 to Ulrich.

The sequence for the manual up and for the manual down operations are shown in the Baler Circuit table. It should be noted that the interlock switches 341, 343, and 363 are required to be properly positioned for the manual down and the manual up operations. In the manual down operation, only chamber door interlock switch 341 and loading door interlock switch 343 are actuated while interlock switch 363 is not. In the manual up operation (primarily used for ejecting a bale from the baler) none of the interlock switches 341, 343, or 363 are actuated. The operation of the circuit 300 of FIG. 2A does not materially differ as to the manual down or the manual up operation as respects the present invention and, thus, these operations will not be discussed in greater detail.

BALER CIRCUIT

| | VALID | RAISE | RETR. | RELAY | | | | | MOTOR | EXT. | RETR. |
|---|---|---|---|---|---|---|---|---|---|---|---|
| DEVICE | ID | PB | LS | R1 | R2 | R3 | R5 | CURR. | CONT. | SOLEN. | SOLEN. |
| MODE AUTO | 301 = Y | 303 = Y | 305 = Y | 307 = N | | | | | | | |
| IDLE | NO | NO | YES | NO | NO | NO | NO | NO | NO | NO | NO |
| BEGIN | YES | NO | YES | YES | NO | NO | YES | NO | YES | YES | NO |
| EXTENDING | NO | NO | NO | YES | NO | NO | YES | NO | YES | YES | NO |
| EXTENDED | NO | NO | NO | YES | NO | YES | YES | YES | YES | NO | NO |
| RETRACTING | NO | NO | NO | YES | NO | YES | YES | NO | YES | NO | YES |
| RETRACTED | NO | NO | YES | NO | NO | NO | NO | NO | NO | NO | NO |
| MODE DOWN | 301 = N | 303 = Y | 305 = N | 307 = N | | | | | | | |

-continued

| | BALER CIRCUIT | | | | | | | | | | |
|---|---|---|---|---|---|---|---|---|---|---|---|
| | VALID | RAISE | RETR. | RELAY | | | | | MOTOR | EXT. | RETR. |
| DEVICE | ID | PB | LS | R1 | R2 | R3 | R5 | CURR. | CONT. | SOLEN. | SOLEN. |
| IDLE | NO | NO | NO | NO | NO | NO | NO | NO | NO | NO | NO |
| BEGIN | YES | NO | NO | YES | NO | NO | NO | NO | NO | NO | NO |
| EXTENDING | NO | NO | YES | YES | NO | NO | YES | NO | YES | YES | NO |
| EXTENDED | NO | NO | YES | NO | NO | NO | YES | YES | YES | NO | NO |
| RETRACTING | NO | NO | YES | NO | NO | NO | YES | NO | NO | NO | NO |
| RETRACTED | NO | NO | NO | NO | NO | NO | NO | NO | NO | NO | NO |
| MODE UP | 301 = N | 303 = N | 305 = N | 307 = Y | | | | | | | |
| IDLE | NO | NO | NO | NO | NO | NO | NO | NO | NO | NO | NO |
| BEGIN | YES | NO | YES | NO | YES | NO | NO | NO | YES | NO | NO |
| EXTENDING | NO | NO | YES | NO | NO | NO | NO | NO | NO | NO | NO |
| EXTENDED | NO | NO | YES | NO | NO | NO | NO | NO | NO | NO | NO |
| RETRACTING | NO | YES | YES | NO | YES | NO | NO | NO | YES | NO | YES |
| RETRACTED | NO | NO | NO | NO | NO | NO | NO | NO | NO | NO | NO |

Figure 2B:
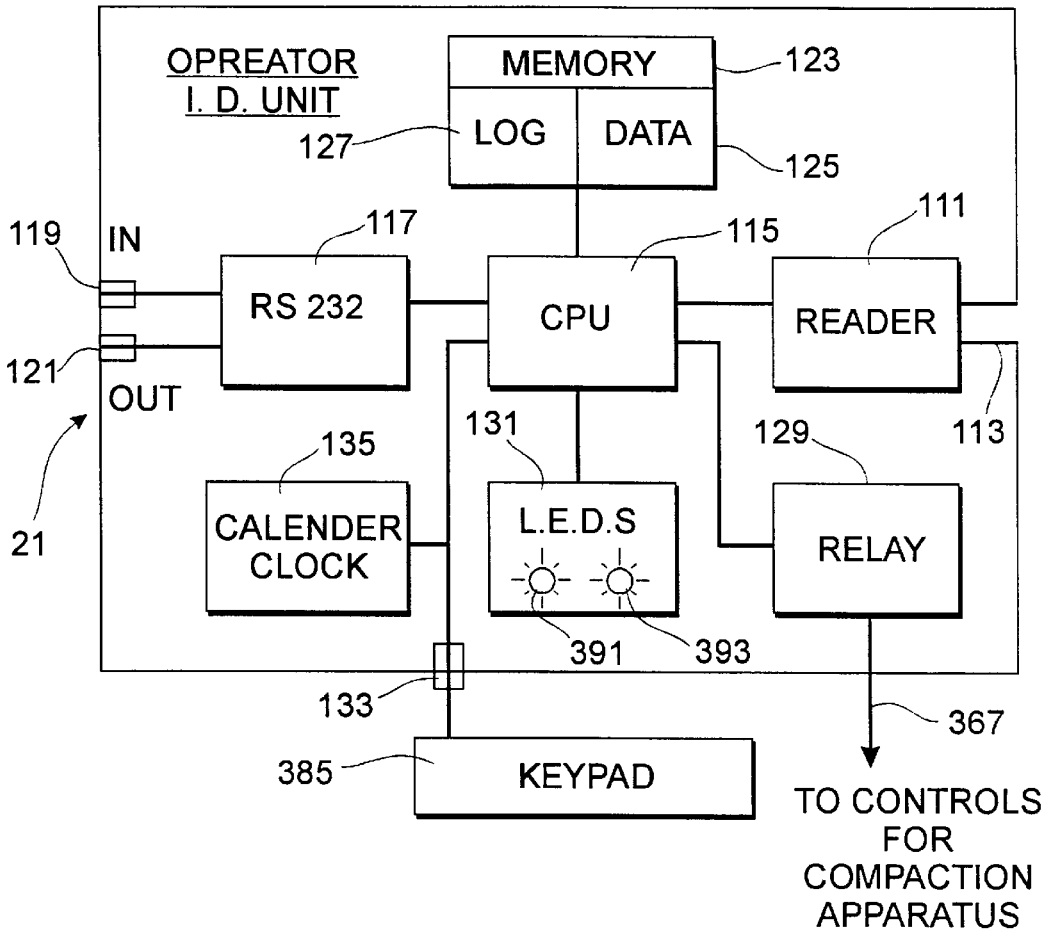
FIG. 2B is a schematic block diagram of an authorized operator identification unit adapted to function with the control system apparatus shown in FIG. 2A.

A schematic block diagram showing the details of card reader and operator ID unit 21 is shown in FIG. 2B. The component parts of operator ID unit 21 are conventional components well known in the art and their detailed construction and operation will, accordingly, not be described here. Operator ID unit 21 includes a conventional card reader 111 which is preferably of the wipe reading type where the card is slipped through the card slot 113 without fully inserting the card into the card reader. However, a different form of magnetic strip card reader could be employed which does require full insertion of the card and, furthermore, reader 111 could be replaced by an equivalent reader employing a punched card or a reader employing an optical scanning device or any similar data acquisition apparatus.

Card reader 111 forms one of the inputs to (central processing unit) CPU 115. CPU 115 is also connected to receive data from or transmit data to an input/output RS232 device 117. RS232 device 117 is a conventional means enabling a CPU such as CPU 115 to communicate with another computer or with a modem or other peripheral device and it is employed in the card reader 21 in a conventional fashion. RS232 device 117 is shown provided with an input 119 and an output 121. However, one connector could be employed for both input or output. It should be noted that with respect to the RS232 device 117 it could in-fact be incorporated in the Central Processor Unit as a part of CPU integrated circuit chip and the same is true of all of the other digital circuit devices shown in FIG. 2B. Another input to central processing unit 115 is a conventional calendar clock 135 (this is also likely to be incorporated within the CPU 115 in an actual implementation.

A keypad 385 is provided as an optional input to the CPU 115 and is connected to the CPU 115 though a conventional connector 133. In the preferred embodiment shown in FIG. 4, keypad 385 is incorporated within the housing of the operator ID unit 21, but it is an optional feature which will frequently be omitted.

CPU 115 is provided with a conventional digital memory 123 which is shown schematically as having one portion 125 reserved for data such as registers of authorized and/or unauthorized operators with another log memory 127 reserved for storing information collected with respect to operations or attempted operations of the compaction apparatus and to the operator associated therewith.

Relay unit 129 is connected to an output of CPU 115 and a connector cable 367 is provided to connect relays or contacts of relay unit 129 for activating or deactivating control circuit 300. As previously explained, one or more multi-contact relays provided at 129 serve to establish connections to conductors A, B, C, D, E, and F such that conductor A is connected to conductor B, conductor C is connected to conductor D, conductor E is connected to conductor F initiating the activate or start condition of control circuit 300. Clearly, this is a situation specific to the baler control circuit and, with respect to each compaction apparatus control circuit, the necessary number and relation of relay contacts would be provided to make electrical connections in a necessary and sufficient manner to start the compaction function which is to be controlled and limited. An external indicator device 131 includes LED's 391 and 393 which are preferably of distinctive colors, for example LED 391 being green and LED 393 being red. External indicator device 131 allows the operator or would-be-operator to be aware of the condition of the circuitry and to be guided as to the action required to operate the compaction apparatus. Electrical cable 367 may also provide input to CPU 115 in conjunction with relays 129 and the modest power requirement of the operator ID unit 21 may also be met through conductors of cable 367.

The operation of the compactor apparatus through the use of operation ID unit 21 and the instructions for such operation are purposely simple and designed to avoid difficulty for operators of relatively little training or experience. Operation of the compaction apparatus by use of operation ID unit 21 may be carried out essentially as follows. When the green run light is on continuously and the baler is not running, the employee is instructed to wipe the employee ID card from top to bottom with the magnetic strip on the left (inside the card slot). Arrows, instructions, or other indications on the card and on the card reader further insure easy orientation of the card in the proper manner.

When the card has been properly wiped through the slot, and if the employee is authorized for operation of the compaction apparatus, this is indicated to the would-be operator when the green run light blinks three times, at which time the baler or other compaction apparatus will start. Conventional computer programming implements this operation by comparing data, such as a Social Security number or portion of a Social Security number, input through reader 111, to the data memory 125 having such identification data for authorized operators stored therein. Authorized operator data in data memory 125 has been input through connector 119 from a hand-held data transfer device or a hand-held computer, notebook personal computer or the like.

If, on the other hand, the operation of CPU 115 in comparing the ID data from reader 111 to data stored in date memory 125 shows that the attempted operation is not by an authorized operator, then the red "error" light will blink three times. In either case, the green run light will return to continuous on, ready to accept input from the next authorized user. Attempted operation of the compaction apparatus by wiping a card through the reader when the compaction apparatus cycle is still in progress will, naturally, not start operation of the compaction apparatus, but neither will it harm the compaction apparatus or its controls.

As previously explained, relay unit 129 containing one or more relays responds to input of authorized operator data and momentarily closes contacts for conductors A-B, C-D, and E-F to signal the main control circuit 300 to start a compaction cycle or a portion thereof. While the starting or non-starting of the compaction apparatus is itself an indication of the receipt of data in the reader 111, indicating either an authorized operator or an unauthorized operator, the green LED 391 and the red LED 393 are important to better communicate operating conditions to the person attempting operation of the compaction apparatus. Clearly, one or both of the LED's 391 or 393 could be omitted or they could be replaced or supplemented by audible signals as may be determined desirable by those skilled in the art. Furthermore, the LED unit 131 which utilizes conventional digital logic could be more complicated and could receive a signal through relay unit 129 and CPU 115 that the compaction cycle or portion of compaction cycle was under way and so indicate a different on/off status for LED's 391 and 393 (e.g. both LED's lit) or by providing additional LED's or other visual or audible indicators.

CPU 115 has associated therewith a calendar clock 135 of conventional form as frequently found in personal computers or the like. Calendar clock 135 has a main function of providing date and time data for log memory 127 which CPU 115 relates to operator identity data from card reader 111. As desired, the operational log data from log memory 127 can be read out by CPU 115 through RS232 unit 117 and serial connector 121 for whatever purpose may be desired in the establishment central computer system. For example, attempted unauthorized use of the compaction apparatus will be recorded with time and date and with whatever data was read by card reader 111 at that time, thus aiding in preventing unauthorized use or attempts at unauthorized use on future occasions.

In another optional use of calendar clock 135 CPU 115 is appropriately programmed so that reader 111 and/or relay unit 129 are disabled on particular days or at particular hours. Such disablement could be indicated by LED's 391 and/or 393 and/or additional LED's provided for that purpose.

Also calendar clock 135 may be used in an optional refinement of the system logic of operator ID unit 21 wherein one of the qualifications for an authorized operator is age. If each prospective operator's card is encoded with the operator's birth date instead of or in addition to the operator's age, then the CPU 115 calculates the operator's age to the current date of calendar clock 135 in determining whether the age qualification is met. This improves efficiency by making it unnecessary to upgrade an operator from unauthorized to authorized and recoding his card on or after the appropriate birthday.

Figure 4:
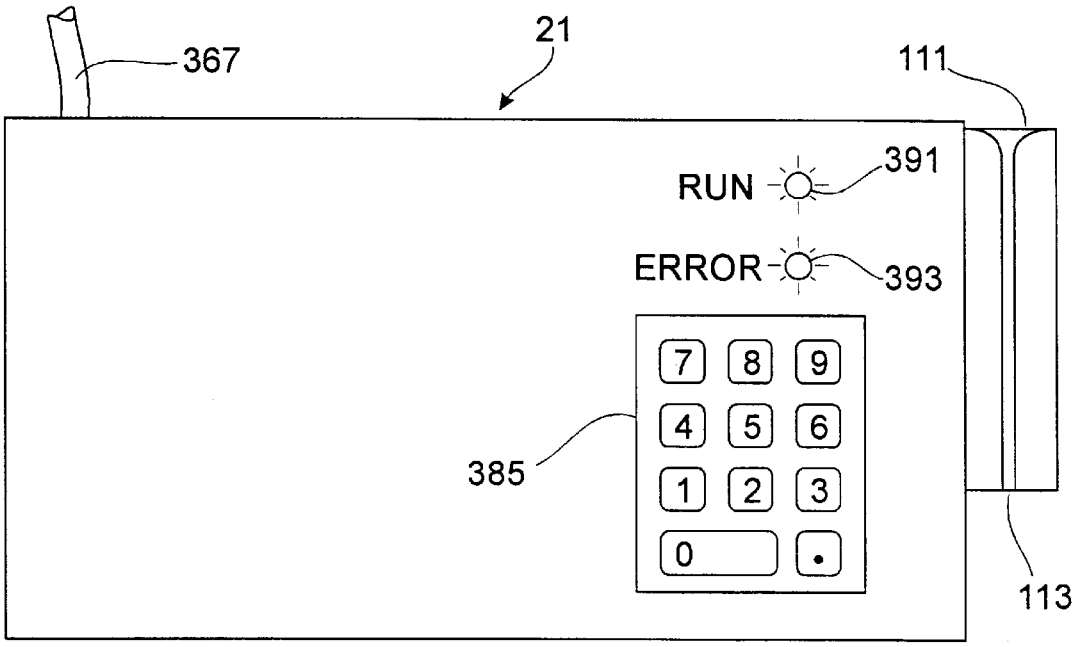
FIG. 4 is an enlarged elevational view of the exterior of the operator identification unit associated with the control panel of FIG. 3.

Keypad 385 is shown in FIG. 2B as connected through connector 133 to the main operator ID unit 21 but it also may be formed integrally in the operator ID unit as shown in FIG. 4. Keypad 385 is an optional feature which may be given one or more of several functions. It may be employed as a further requirement to validate the identity of a prospective operator in a manner similar to the PIN number commonly used in connection with automated teller machines. Alternatively it may be used to override or substitute for data from reader 111 or otherwise aid supervisory personnel in overcoming any problems that might arise. While keypad 385, especially if it were expanded to a full keyboard, could be utilized to enter data into the memory 123, this is substantially less satisfactory than employment of input and output terminals 119 and 121 and RS232 unit 117.

It will be understood that FIG. 2B is a schematic illustration of particular forms of known components with a particular configuration that is a useful and preferred form of apparatus for implementing the invention, innumerable variations therein might be made some of which have been previously suggested. Certain of the components could be omitted or replaced by equivalent components or components with a similar function as will be understood by those of skill in the art. Those possible substitutions suggested in the course of the description will not be repeated here. It should be pointed out that the schematic block diagram of FIG. 2B has presented the apparatus in the form of functional blocks, but in actual practical apparatus, these functions may very well be integrated on a single semi-conductor chip or otherwise combined so that their separate functional identities are not readily apparent. Clearly it is the intent that the scope of the invention will include such integrated versions of the apparatus and the presentation of FIG. 2B is understood to aid in understanding the function of the invention rather than depicting a physical embodiment thereof.

Figure 3:
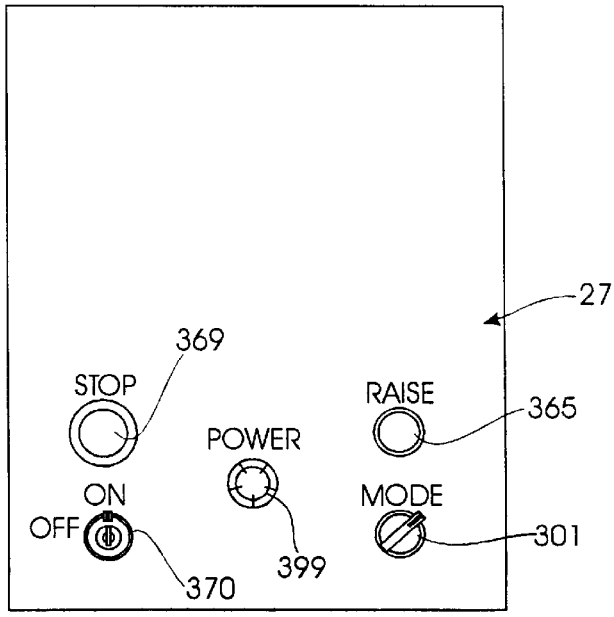
FIG. 3 is an enlarged elevational view of the main control panel for the apparatus shown in FIG. 1.

FIG. 3 shows the main control 27 of the compaction apparatus. The external appearance of the box for controls 27 is shown for illustration only and the appearance and components thereof may vary widely without affecting the scope and operation of the improved operator identification features to which this disclosure is directed. Generally, the front view of the controls 27 shows the externally accessible elements of switches more fully described in connection with the schematic circuit diagram of FIG. 2A. Thus, mode switch 301 is shown manually operable to select between auto down and up modes. Raise switch is manually operable by means of its button shown in FIG. 3. Likewise stop button 369 is shown which is preferably a pull on and push off convention stop button for safety purposes allowing quick emergency stop of the baler. On/off switch 370 may be of conventional form and optionally may be a key operated switch. It will be noted that switch 370, even though key operated, will not operate or allow operation of the compaction equipment without an appropriate signal from the operator ID unit 21. This is a distinguishing feature from the otherwise generally similar baler apparatus shown in copending application Ser. No. 09/218,348. Power lamp 399 is a conventional indicator providing information that power is being supplied to the compaction apparatus (with switch 370 on). The function of power lamp 399 may be assumed or duplicated by LED unit 131 and LED's 391 and 393.

In the case of other forms of compaction apparatus those with the operator ID feature according to the invention here may have an appearance and functional organization generally the same as those without such improvement. The major distinction in the main controls for a compaction unit according to the invention is that there will be no external access to a switch, key, button or lever which will cause a start of a compaction operation. Rather, the start of an operation must be initiated by causing card reader 111 of FIG. 2B to read data from an employee's card designating such employee as an authorized operator.

FIG. 4 illustrates an exemplary external appearance for an operator ID unit 21 having a card reader 111 provided with a slot 113 through which magnetic strip cards may be passed to read the data thereon. LED's 391 and 393 explained in FIG. 2B are shown together with keypad 385 which is an optional feature which may often be omitted without otherwise affecting the general appearance of FIG. 4. The particular form of keypad 385 may vary from a minimal numeric keypad as shown in FIG. 4 to a more extensive keypad having additional symbols, keys, or, in some cases, a full alpha-numeric keyboard. The function of the elements whose external appearance is shown in FIG. 4 has been explained heretofore and will not be repeated.

It will be appreciated that variations and modifications may also be made to the manner in which operator ID data is input to the operator ID unit 21 and, specifically, data memory 125. Although such data transmission is disclosed as being implemented through an RS232 unit 117, the RS232 circuitry being very common and readily available, there are other similar circuits such as an RS485, an RS422 and others which can in alternative embodiments perform essentially the same function performed by the RS232.

It should be further noted that, while it is convenient to transfer operator and employee data from a facility main computer to a notebook computer or other portable data transfer device and thence to the operator ID unit 21 as disclosed in the preferred embodiments, there are other means of data transfer which may be desirable in certain circumstances. For example, the desired operator ID data could be communicated directly from the facility main computer to the operator ID unit 21 over hardwired cable, infrared data link, fiberoptic cable, radio link or any other of many well-known data communication link means. In other cases, the data could be transmitted by a dial up telephone-modem communication link. It will be understood that, in referring to a main computer for the facility, this will include a desktop computer with personnel information, a desktop computer network, or a desktop computer dedicated for the purpose of providing operator ID information.

From the foregoing description, the general operation of the specific baler control circuit of FIG. 2A and FIG. 2B will be understood, and it will be appreciated that control systems for other compaction apparatus may be similarly adapted to be enabled only upon receipt of a signal representing insertion of a valid operator ID card in operator ID unit 21.

Whereas, the present invention has been described in relation to the drawings attached hereto, it should be understood that other and further modifications, apart from those shown or suggested herein, may be made within the spirit and scope of this invention.

What is claimed is:

1. In a trash compaction apparatus control system, the improvement comprising:

a card reader;

a computer including a memory adapted to record at least a portion of electronic data read by said card reader;

said computer being programmed to process said electronic data to provide means to determine if a person identified by such data is authorized to operate said compaction apparatus;

means for recording the identity of each operator whose card was used to attempt operation of said compaction apparatus; and means for providing an external indication of an attempt to operate the compaction apparatus by an unauthorized person.

2. Apparatus as recited in claim 1 wherein said computer further includes calendar and clock means and means for recording the time and date of each attempt to operate said compaction apparatus.

3. Apparatus as recited in claim 2 further including means responsive to said computer and authorized person determination thereby for enabling a start routine of said trash compactor apparatus control system.

4. Apparatus as recited in claim 3 wherein said means to determine whether a person is authorized to operate said compaction apparatus includes means for comparing birth date data read by said card reader with the current date from said calendar means to allow only a person who is qualified by age to operate such compaction apparatus.

5. Apparatus as recited in claim 4 including a keypad accessible to a prospective operator of said apparatus and connected to input data to said computer as an additional means of determining if a person is authorized to operate said compaction apparatus.

6. Apparatus as recited in claim 3 including a keypad accessible to a prospective operator of said apparatus which keypad inputs data to said computer as an additional means of determining if a person is authorized to operate said compaction apparatus.

7. Apparatus as recited in claim 6 wherein said means for providing an external indication of an attempt to operate said compaction apparatus by an authorized person, includes at least one visual indicator associated with said control system controlled by said computer to provide an indication of authorized or unauthorized status for a person attempting to operate said trash compaction apparatus.

8. Apparatus as recited in claim 7 including a keypad accessible to a prospective operator of said apparatus which keypad inputs data to said computer as an additional means of determining if a person is authorized to operate said compaction apparatus.

9. Apparatus as recited in claim 3 wherein said means for providing an external indication of an attempt to operate said compaction apparatus by an authorized person, includes at least one visual indicator associated with said control system controlled by said computer to provide an indication of authorized or unauthorized status for a person attempting to operate said trash compaction apparatus.

10. Apparatus as recited in claim 1 wherein said means for providing an external indication of an attempt to operate said compaction apparatus by an authorized person, includes at least one visual indicator associated with said control system controlled by said computer to provide an indication of authorized or unauthorized status for a person attempting to operate said trash compaction apparatus.

11. In a trash compaction apparatus control system, the improvement comprising:

a magnetic strip card reader;

a computer including a memory adapted to record at least a portion of electronic data read by said magnetic strip card reader;

said computer being programmed to process said electronic data to provide means to determine if the person identified by such data is authorized to operate said compaction apparatus;

means for recording the identity of each operator whose card was used to attempt operation of said compaction apparatus;

said computer further including calendar and clock means and means for recording the time and date of each attempt to operate said compaction apparatus;

means for enabling a start routine of said trash compaction apparatus control system, and means for providing an indication of an attempt to operate said compaction apparatus by an unauthorized person.

12. Apparatus as recited in claim 11 wherein said means to determine whether a person is authorized to operate said compaction apparatus includes means for comparing birth date data read by said magnetic strip card reader with the current date from said calendar means to allow only a person who is qualified by age to operate such compaction apparatus.

13. Apparatus as recited in claim 11 including a keypad accessible to a prospective operator of said apparatus and connected to input data to said computer as an additional means of determining if a person is authorized to operate said compaction apparatus.

14. Apparatus as recited in claim 13 wherein said means for providing an indication of an attempt to operate said compaction apparatus by an authorized person, includes at least one visual indicator associated with said control system controlled by said computer to provide an indication of authorized or unauthorized status for a person attempting to operate said trash compaction apparatus.

15. Apparatus as recited in claim 11 wherein said means for providing an indication of an attempt to operate said compaction apparatus by an authorized person, includes at least one visual indicator associated with said control system controlled by said computer to provide an indication of authorized or unauthorized status for a person attempting to operate said trash compaction apparatus.

16. In a trash compaction apparatus control system, the improvement comprising:

a magnetic strip card reader;

a computer including a memory adapted to record at least a portion of electronic data read by said magnetic strip card reader;

said computer being programmed to process said electronic data to provide means to determine if the person identified by such data is authorized to operate said compaction apparatus;

further means for validating the identity of a prospective operator including a key data entry device adapted to enter a code further identifying the person identified by said electronic data read by said magnetic strip card reader;

means for recording the identity of each operator whose card is used to attempt operation of said compaction apparatus;

said computer further including a digital calendar and a digital clock and means for recording the time and date and operator ID for each attempt to operate said compaction apparatus;

said means to determine whether a person is authorized to operate said compaction apparatus includes means for comparing birth date data read by said magnetic strip card reader with the current date from said calendar to allow only a person who is qualified by age to operate such compaction apparatus;

means responsive to said computer for enabling a start routine of said trash compaction apparatus control system, and means for providing an external indication of an attempt to operate said compaction apparatus by an unauthorized person.

* * * * *